US005577407A

United States Patent [19]

Savkar et al.

[11] Patent Number: 5,577,407

[45] Date of Patent: Nov. 26, 1996

[54] WASHER AUGER WITH GRAVITY ASSISTED RATCHET DRIVE

[75] Inventors: Sudhir D. Savkar, Schenectady; Roger N. Johnson, Hagaman, both of N.Y.; Brian D. Lisek, Louisville, Ky.

[73] Assignee: General Electric Company, Schenectady, N.Y.

[21] Appl. No.: 511,940

[22] Filed: Aug. 7, 1995

[51] Int. Cl.[6] ..... D06F 17/08

[52] U.S. Cl. ..... 68/133; 192/46

[58] Field of Search ..... 68/133, 134; 192/46

[56] References Cited

U.S. PATENT DOCUMENTS 4,719,769 1/1988 Pielemeier et al. ..... 68/133

5,479,793 1/1996 Savkar et al. ..... 68/133

*Primary Examiner*—Philip R. Coe

*Attorney, Agent, or Firm*—Paul R. Webb, II

[57] ABSTRACT

A drive mechanism for converting rotary oscillation of a washing machine clothes agitator to intermittent unidirectional rotation of an adjoining clothes auger includes a ratchet wheel and cooperating ratchet pawls. The wheel includes axially oppositely facing top and bottom sides, with the top side having a plurality of circumferentially spaced apart ratchet teeth, and the bottom side being configured for being fixedly joined to the clothes agitator. The pawls are vertically suspended from a support disk for allowing gravity to engage the pawls with the ratchet teeth as the ratchet wheel oscillates with the agitator, with the support disk being driven in a single direction by the pawls for correspondingly rotating the auger joinable thereto.

10 Claims, 3 Drawing Sheets

WASHER AUGER WITH GRAVITY ASSISTED RATCHET DRIVE

The present invention relates generally to clothes washing machines, and, more specifically, to a washing machine having a vertical agitator and auger operatively joined together by a ratchet drive.

BACKGROUND OF THE INVENTION

Clothes washing machines can either be vertical or horizontal axis for moving clothes during the washing operation. In the horizontal washing machine, the drum or basket rotates either in one direction or intermittently in both directions causing the clothes therein to tumble during the washing operation in the soap and water cleaning solution. In the vertical washing machine, the agitator reciprocates or oscillates to continually change its rotation direction for moving the clothes to effect cleaning thereof in the soap and water solution.

In order to improve clothes moving in the vertical washing machine, it is known to also include an auger having a spiraling vane or screw disposed coaxially atop the agitator. Disposed between the auger and the agitator is a conventional ratchet mechanism which converts the oscillating, bidirectional rotation of the agitator into unidirectional rotation of the auger so that the auger screw is rotated for pulling the clothes downwardly in operation in the cleaning solution for improving the effectiveness of the washing operation.

A typical ratchet mechanism includes a disk attached to the top of the agitator from which extends radially outwardly therefrom a plurality of ratchet pawls. A cooperating ratchet wheel in the form of a ring having a plurality of radially inwardly facing ratchet teeth attached to the bottom of the auger is disposed in a common axial (horizontal) plane with the pawls. Oscillation of the agitator in turn imparts force on the pawls which intermittently are driven radially outwardly for engagement with the cooperating ratchet teeth. As the agitator rotates in one direction, the pawls are driven radially outwardly and engage the ratchet teeth for also rotating the auger in the same direction. However, when the agitator rotates in the opposite direction, the pawls disengage the ratchet teeth and are indexed to succeeding teeth without imparting additional rotation to the auger. In the next cycle, the ratcheting action is repeated so that the auger rotates solely in one direction as the agitator oscillates in two directions.

Since the pawls and teeth are disposed in a common horizontal plane and require initial pivoting of the pawls to engage the teeth, lost motion occurs therefrom. Accordingly, optimum efficiency of conversion of the oscillating agitator rotation to the unidirectional rotation of the auger is not achieved, which correspondingly decreases the efficiency of the washing operation.

SUMMARY OF THE INVENTION

A drive mechanism for converting rotary oscillation of a washing machine clothes agitator to intermittent unidirectional rotation of an adjoining clothes auger includes a ratchet wheel and cooperating ratchet pawls. The wheel includes axially oppositely facing top and bottom sides, with the top side having a plurality of circumferentially spaced apart ratchet teeth, and the bottom side being configured for being fixedly joined to the clothes agitator. The pawls are vertically suspended from a support disk for allowing gravity to engage the pawls with the ratchet teeth as the ratchet wheel oscillates with the agitator, with the support disk being driven in a single direction by the pawls for correspondingly rotating the auger joinable thereto.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
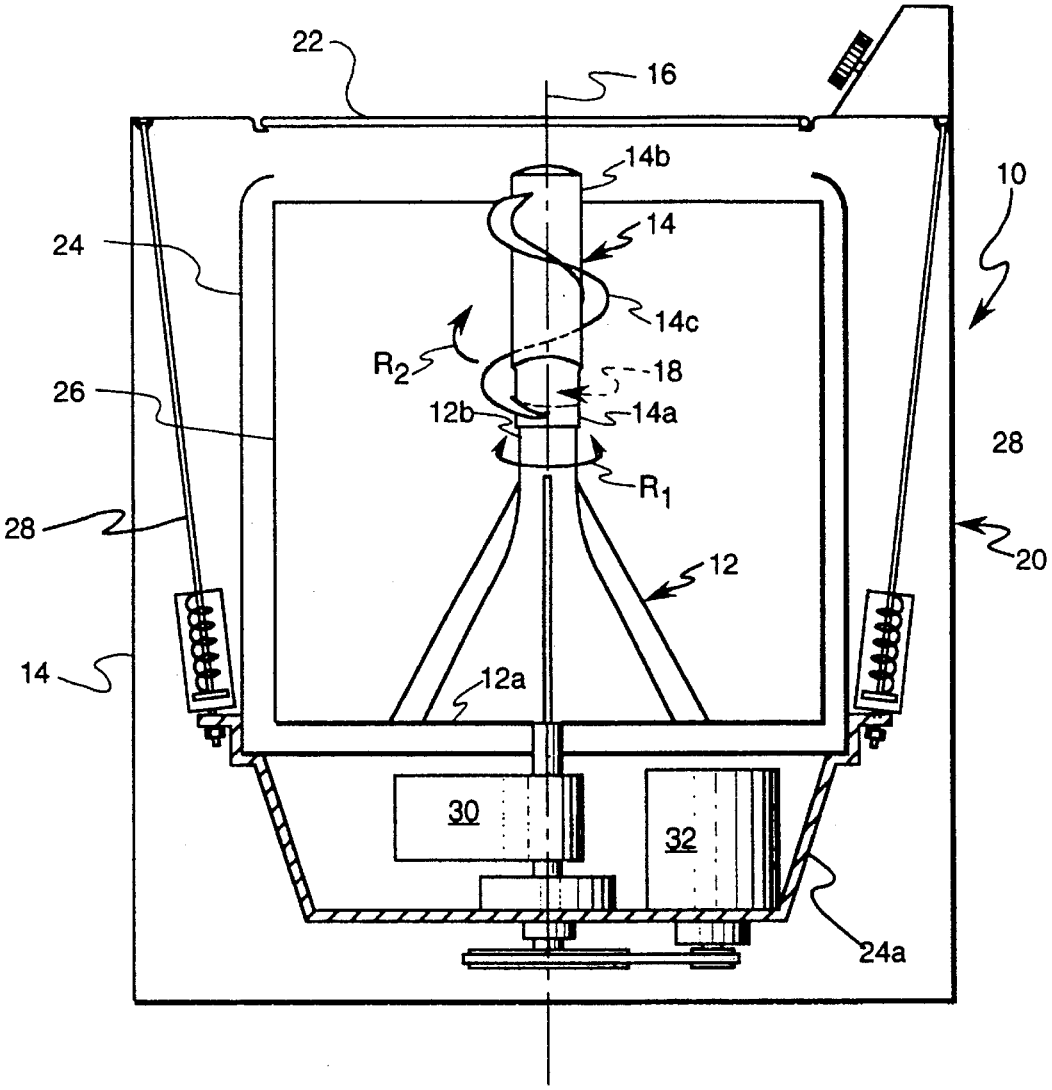
FIG. 1 is a schematic, elevational, partly sectional view of an exemplary vertical agitator washing machine including a coaxial clothes auger joined thereto by a ratchet drive mechanism in accordance with one embodiment of the present invention.

Illustrated schematically in FIG. 1 is an exemplary clothes washing machine 10 having a clothes agitator 12 disposed coaxially with a clothes auger 14 about a vertical, axial centerline axis 16. A drive mechanism 18 in accordance with the present invention joins the auger 14 to the agitator 12 for converting bidirectional rotary oscillation $R_1$ of the agitator 12 to unidirectional rotary motion or rotation $R_2$ of the coaxially adjoining auger 14.

In the exemplary embodiment illustrated in FIG. 1, the washing machine 10 includes a conventional housing 20 with a central opening at its top having a hinged lid 22 which may be opened or closed for loading or unloading clothes, as well as for providing the soap or detergent into the washing machine 10. Disposed inside the housing 20 is a conventional tub 24 open at its top end and configured for containing the washing water therein. Inside the tub 24 is a conventional perforated basket 26 within which are centrally disposed the agitator 12, auger 14, and connecting drive mechanism 18 which are effective for moving clothes placed therein in a soap and water cleaning solution (not shown). The tub 24, as well as the components therein, is conventionally supported in the housing 20 by a plurality of spring suspensions 28.

Suspended from the bottom of the tub 24 is an integral frame **24*a* which supports a conventional transmission 30 and electrical drive motor 32 operatively joined together by a pulley and belt system. The motor 32 is effective for driving the transmission 30 for oscillating a conventional drive shaft 34 joined to the agitator 12** for imparting the desired bidirectional rotation $R_1$ thereto.

As shown in FIG. 1, the agitator 12 includes a bottom or proximal end **12*a* which is disposed at the bottom of the basket 26 and through which the drive shaft 34 extends axially upwardly and is conventionally fixedly joined to the agitator 12. The agitator 12 includes a top distal end 12*b* which is inserted into a bottom or proximal end 14*a* of the auger 14. The auger 14 has a top or distal end 14*b*, and a conventional vane or screw 14***c* spirals upwardly around the auger 14 from the bottom to top ends 14*a,b*. The auger screw 14*c* has a left-hand spiral in this exemplary embodiment, with the drive mechanism 18 being configured for imparting unidirectional, clockwise rotation $R_2$ for pulling the clothes vertically downwardly during the washing operation. In alternate embodiments, the auger screw 14*c* can have a right-hand spiral, with the drive mechanism 18 being oppositely configured for rotating the auger in a counterclockwise direction.

Figure 2:
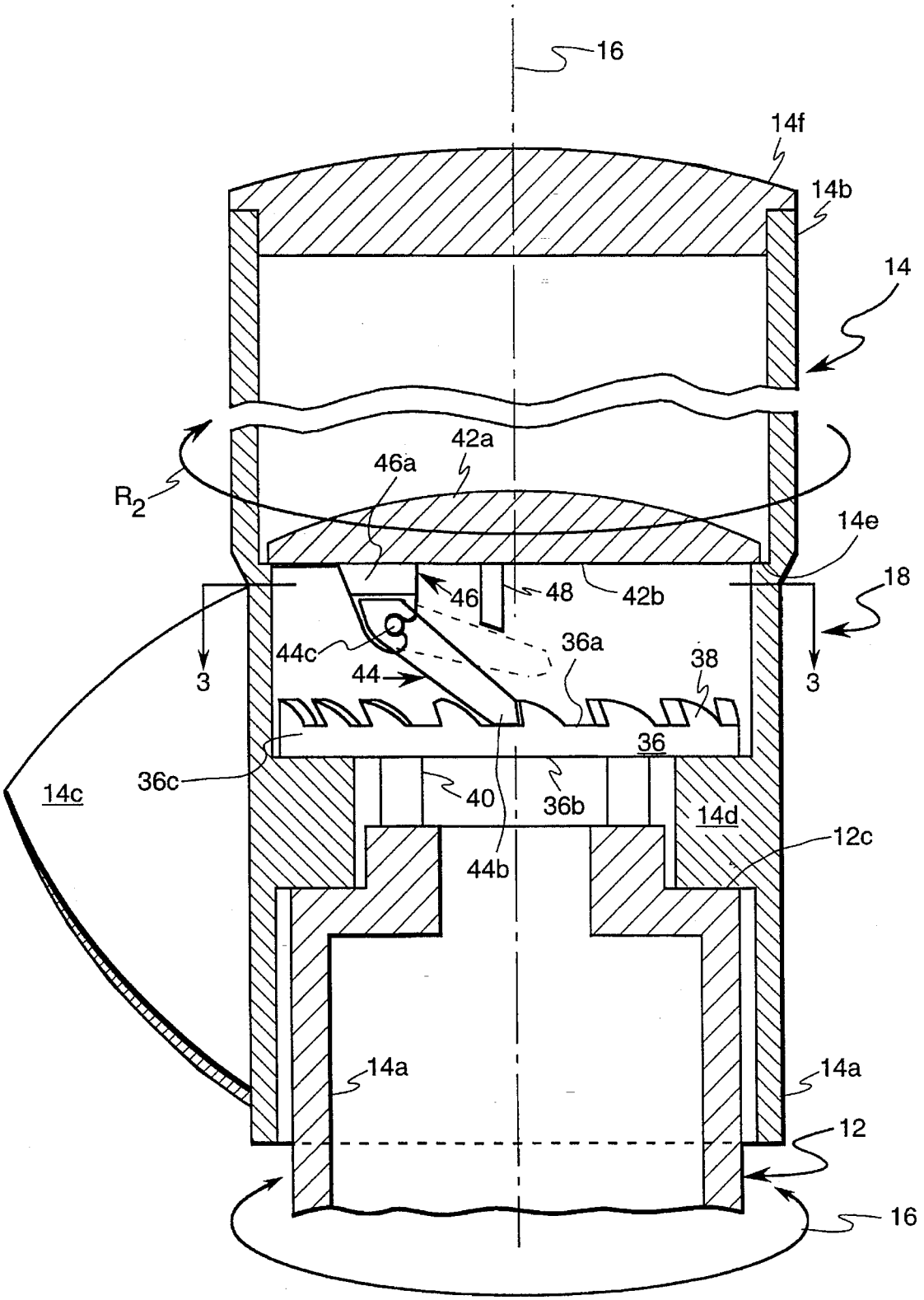
FIG. 2 is an enlarged, elevational, partly sectional view through the ratchet drive mechanism joining the agitator and auger illustrated in FIG. 1.

The drive mechanism 18 is illustrated in more particularity in FIG. 2 in accordance with an exemplary embodiment of the present invention for imparting clockwise rotation $R_2$ of the auger 14, since the auger screw 14*c* has a left-hand spiral. As shown in the exemplary embodiment illustrated in FIGS. 2 and 3, a ratchet wheel 36 includes axially or vertically oppositely facing top and bottom sides 36*a*, 36*b*, and a smooth and uninterrupted perimeter 36*c* therebetween. The wheel bottom side 36*b* is preferably flat and configured for being fixedly joined to the agitator 12 as described below. The wheel top side 36*a* includes a plurality of circumferentially spaced apart ratchet teeth 38 disposed in a circular array radially inwardly of the wheel perimeter 36*c*. The ratchet teeth 38 may take any conventional form and extend axially, perpendicularly outwardly or vertically upwardly from the wheel top side 36*a* in accordance with one embodiment of the present invention.

Figure 3:
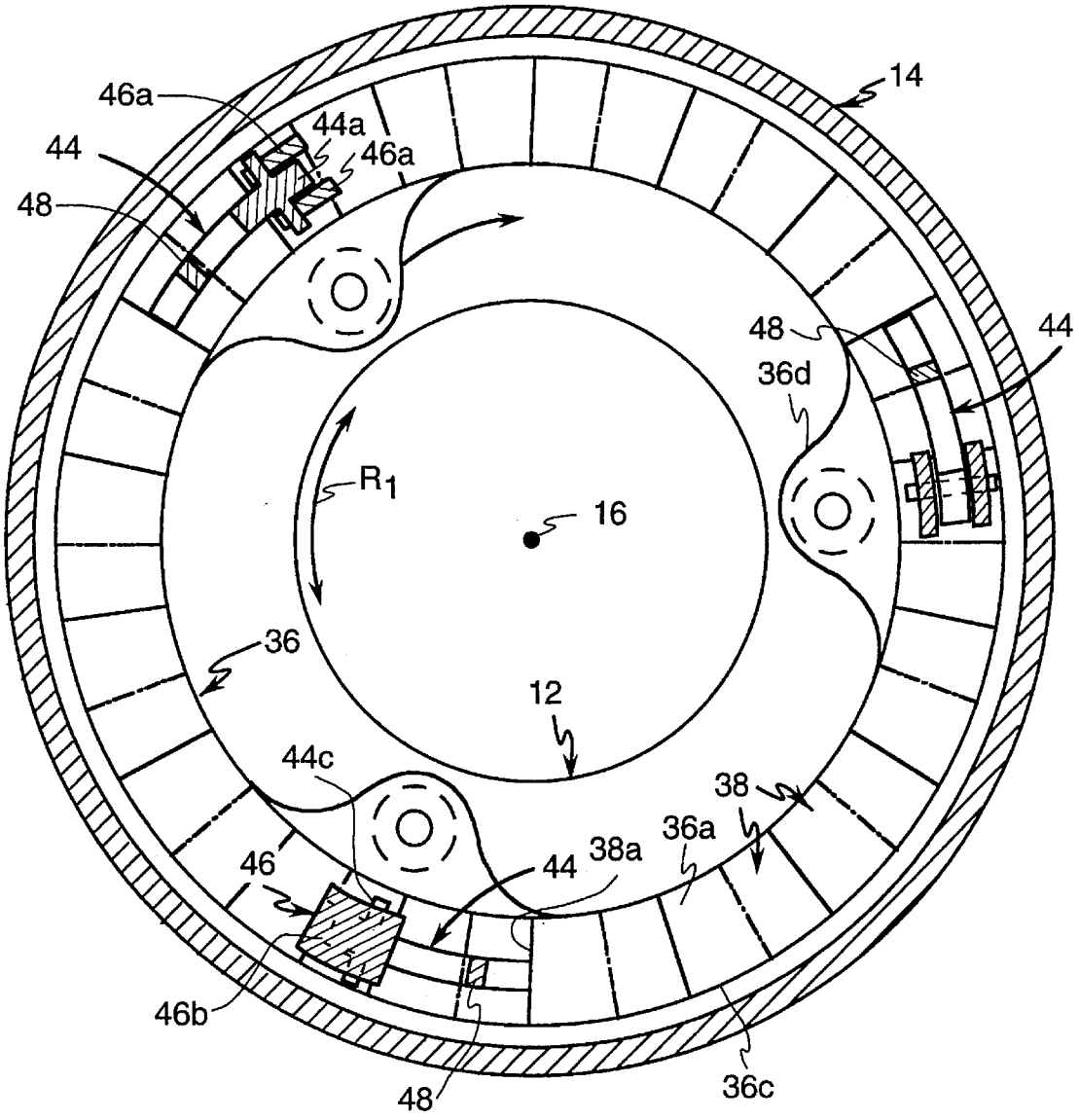
FIG. 3 is a transverse, partly sectional view of the drive mechanism illustrated in FIG. 2 and taken generally along line 3—3.

As shown in FIG. 2, the agitator 12 further includes an annular step flange 12*c* therearound at its top end 12*b*. The auger 14 is hollow and includes a radially inwardly extending first support flange 14*d* disposed adjacent to the bottom end 14*a* thereof and axially between the bottom side 36*b* of the ratchet wheel 36 and the agitator step flange 12*c*, and is trapped therebetween for securing the auger 14 to the agitator 12. As shown in FIGS. 2 and 3, a plurality, three for example, of mounting posts 40 are circumferentially spaced apart from each other and extend axially upwardly from the agitator top end 12*b* and are suitably fixedly joined to the ratchet wheel 36. As shown in the exemplary embodiment illustrated in FIG. 3, the ratchet wheel 36 includes a respective plurality of radially inwardly extending mounting tabs 36*d* which are suitably fixedly joined to the mounting posts 40.

For example, the mounting posts 40 may have suitable plastic pins extending therefrom which engage with complementary openings in the mounting tabs 36*d*, with the pins being suitably melted and solidified for plastically riveting the ratchet wheel 36 to the mounting posts 40. During assembly, the hollow auger 14 is firstly inserted downwardly over the agitator top end 12*b* for engaging the complementary flanges 12*c* and 14*d*. The ratchet wheel 36 is then inserted through the open auger top end 14*b* into position over the mounting posts 40 and then suitably secured thereto. The axial height of the auger support flange 14*d* is selected so that it is suitably axially trapped between the bottom of the ratchet wheel 36 and the agitator step flange 12*c* with sufficient clearance to permit rotation of the auger 14 relative to the agitator 12.

Referring again to FIG. 2, the mechanism 18 further includes an annular support cover or disk 42 and is configured for being fixedly joined to the auger 14 generally parallel to the ratchet wheel 36 and coaxially therewith. The support disk 42 has axially oppositely facing top and bottom sides 42*a* and 42*b*, with the disk bottom side 42*b* facing the ratchet teeth 38 and the ratchet wheel top side 36*a*, and being spaced axially upwardly therefrom. In the exemplary embodiment illustrated in FIG. 2, the hollow auger 14 further includes a second annular support flange 14*e* spaced suitably axially above the first support flange 14*d* for receiving the perimeter of the support disk 42 which is suitably sealingly joined thereto for creating a conventional air bell below the support disk 42 for preventing entry of the washing solution therein during operation. The support disk 42 is thusly joined to the auger 14 axially above the ratchet wheel 36 for allowing ratchet engagement between the pawls 44 and the ratchet teeth 38 for rotating the auger 14 upon oscillation of the agitator 12. The auger 14 and the support disk 42, as well as the agitator 12, are preferably plastic, with the support disk 42 being suitably bonded to the second support flange 14*e* by a suitable adhesive or plastic welding technique. The open top end 14*b* of the auger 14 allows assembly of the drive mechanism 18, and is suitably closed by a cap 14*f* or other suitable component.

Figure 4:
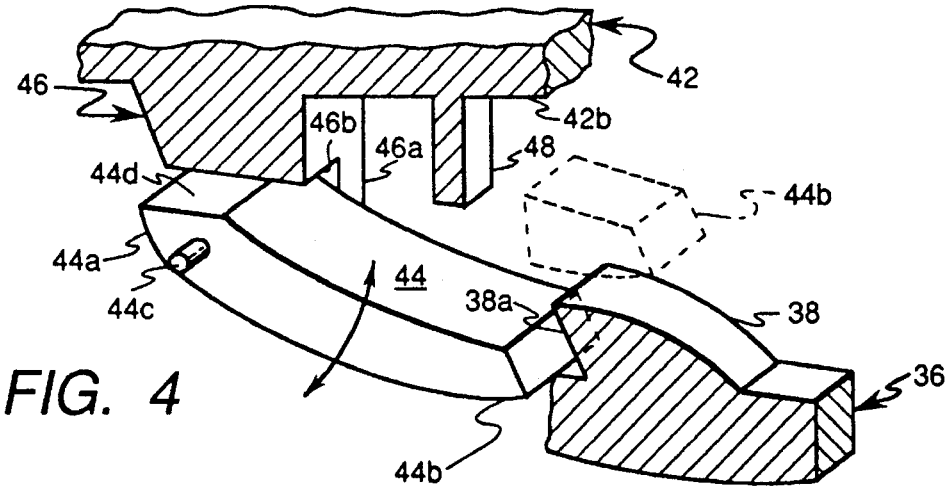
FIG. 4 is a perspective view of portions of an exemplary ratchet pawl and cooperating ratchet tooth found in the drive mechanism illustrated in FIG. 2.

Referring to FIGS. 2 and 3, the mechanism 18 further includes a plurality of equiangularly circumferentially spaced apart ratchet pawls 44 suspended from the support disk 42 for ratchet engagement with the cooperating ratchet teeth 38. An exemplary one of the pawls 44 is illustrated in FIG. 4 and is an elongate member having a proximal end 44*a* pivotally joined to the support disk 42, and a distal end 44*b* which is complementary to the ratchet teeth 38 for intermittent ratcheting and camming engagement therewith. As shown in FIGS. 2 and 4, each of the pawls 44 is generally vertically suspended from the support disk 42 for allowing gravity to act on the center of gravity thereof to engage the pawls 44 with corresponding ones of the ratchet teeth 38 as the ratchet wheel 36 oscillates during operation ($R_1$) to rotate the support disk 42 in a single direction ($R_2$). Whereas conventional ratcheting mechanisms rely on centrifugal force of pawls pivotable only in a horizontal plane, the drive mechanism 18 in accordance with the present invention instead uses gravity to engage the vertically suspended pawls 44 for improving conversion efficiency of oscillation motion of the agitator 12 to unidirectional rotation of the auger 14.

The pawls 44 may take various suitable forms and be suitably suspended from the support disk 42. In the exemplary embodiment illustrated in FIG. 2, an exemplary one of several support clevises 46 is shown for pivotally supporting the respective pawls 44. FIG. 3 illustrates the plurality of circumferentially spaced apart clevises 46 each of which includes a pair of spaced apart legs 46*a* and a flat base 46*b* therebetween (shown in more particularity in FIG. 4) which define a generally U-shaped slot for receiving the pawl distal end 44*a*. As shown in FIGS. 2 and 4, each of the clevises 46 is fixedly joined to or is preferably integral with the disk bottom side 42*b* and is also preferably plastic. The pawls 44 are also plastic and suitably rigid, and include a pair of respective pivot pins 44*c* fixedly joined to or extending integrally from both sides of respective ones of the pawl proximal ends 44*a*. The pivot pins 44*c* are pivotally joined to the clevis legs 46*a* for pivotally mounting the respective pawls 44 thereto. As shown in FIG. 2, each of the pawl legs 46*a* has a generally C-shaped open ended aperture which is suitably sized so that the pawl pins 44*c* may be readily assembled thereto by elastically snapping the pawl pins 44*c* therein, which provides a simple supporting arrangement, and easy assembly.

In an alternate embodiment (not shown), the pawls 44 could be fixedly and integrally joined to the support disk 42 at their proximal ends 44*a* and be suitably flexible along their longitudinal axes so that they can readily deflect vertically upwardly and downwardly along the centerline axis 16 for engagement and disengagement with the ratchet teeth 38. Although vertically flexible, such pawls would be relatively rigid along their longitudinal axes for allowing compressive load therethrough so that the engaged ratchet teeth 38 can rotate the support disk 42 and in turn the auger 14 during operation.

In the exemplary embodiment illustrated in the Figures, the pawl distal ends 44*b* have a suitable pointed shape which is complementary to the ratchet teeth 38 for engagement therewith to carry compression through the pawls 44. In alternate embodiments, the pawl distal ends 44*b* could be in the form of generally L-shaped hooks and be configured for carrying tension through the pawls 44 for converting motion between the ratchet wheel 38 and the support disk 42.

As shown in FIG. 4, each of the ratchet teeth 38 includes a flat, inclined contact face 38*a*, which as shown in FIG. 3, faces generally circumferentially, or tangentially, and is disposed radially inwardly of the wheel perimeter 36*c*. As shown in FIG. 2, each of the pawls 44 extends circumferentially and is inclined and horizontally (as well as vertically), at about 45° for example, for allowing the pawl distal ends 44*b* to intermittently engage the contact faces 38*a* of the corresponding ratchet teeth 38 by axial or vertical movement thereof for rotating the support disk 42 when the pawls 44 and the teeth 38 are engaged as shown in solid line in FIG. 2. When the pawls 44 and the teeth 38 are not engaged, as shown in phantom line in FIG. 2, no rotation of the support disk 42 is imparted therebetween. With the pawl distal ends 44*b* engaged with the teeth contact spaces 38*a*, a compression load is carried through the pawls 44 for rotating the support disk 42 and in turn the auger 14.

Accordingly, gravity provides an effective means for ensuring that the pawls 44 promptly engage the cooperating ratchet teeth 38 with a minimum amount of lost motion therewith when the agitator 12 and attached ratchet wheel 36 are rotating in the same direction ($R_2$) as the auger 14. When the agitator 12 and attached ratchet wheel 38 rotate in the opposite direction, the top sides of the teeth 38 act as cams for lifting the pawls 44 against the force of gravity which disengages the pawls 44 from the teeth 38 without imparting any additional rotation to the support disk 42.

As shown in FIG. 4, each of the pawls 44 preferably also includes a flat extension 44*d* at the top of the proximal ends 44*a* thereof which is predeterminedly spaced from the clevis base 46*b* for engagement therewith to limit downward overtravel of the pawl 44 under gravity. For example, during assembly of the support disk 42 with the pawls 44 joined thereto, the pawl extension 44*d* and the cooperating clevis base 46*b* provide means for preventing excessive axial downward travel of the pawls 44 due to gravity acting thereon to prevent extension of the pawls 44 in the wrong (opposite) direction, and therefore allows for ready engagement of the pawls 44 with the cooperating ratchet teeth 38.

It is also desirable to provide means for preventing excessive axial upward travel of the pawls 44 due to the camming action of the ratchet teeth 38 against the pawl distal ends 44*b*. As shown in FIGS. 2 and 4, a plurality of up-travel stops 48 in the form of short beams integrally joined to the bottom side 42*b* of the support disk 42 extend axially downwardly therefrom and are predeterminedly axially spaced from respective ones of the pawls 44 for engaging the pawls 44 at intermediate sections thereof to limit upward overtravel thereof due to the camming action of the ratchet teeth 38 when they rotate in the direction opposite to the rotation of the auger 14.

The agitator 12, auger 14, and various components of the drive mechanism 18, are all preferably made of a suitable corrosion resistant material such as plastic, e.g. polypropylene, with the required bonding between the respective joined components being conventionally accomplished using suitable adhesive or plastic welding. The vertically suspended pawls 44 provide a simple, reliable, and inexpensive means for imparting single direction rotation of the auger 14 from the oscillating rotation of the agitator 12. The rotation conversion provides improved efficiency over conventional, centrifugally actuated pawls in ratchet mechanisms.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A drive mechanism for converting rotary oscillation of a washing machine clothes agitator to unidirectional rotation of a coaxially adjoining clothes auger comprising:

a ratchet wheel having a perimeter and axially oppositely facing top and bottom sides, said bottom side being flat and configured for being fixedly joined to said agitator, and said top side having a plurality of circumferentially spaced apart ratchet teeth extending perpendicularly outwardly therefrom;

an annular support disk configured for being fixedly joined to said auger generally parallel to said wheel and coaxially therewith, said support disk having axially oppositely facing top and bottom sides, with said disk bottom side facing said ratchet teeth and being spaced therefrom; and a plurality of circumferentially spaced apart ratchet pawls, each having a proximal end pivotally joined to said support disk, and a distal end being complementary to said ratchet teeth for intermittent ratcheting engagement therewith, and said pawls being vertically suspended from said support disk for allowing gravity to engage said pawls with corresponding ones of said ratchet teeth as said ratchet wheel oscillates to rotate said support disk in a single direction.

2. A drive mechanism according to claim 1 wherein:

said ratchet teeth have contact faces facing generally circumferentially and disposed radially inwardly of said wheel perimeter; and said pawls are inclined horizontally and extend circumferentially for allowing said pawl distal ends to intermittently engage said contact faces of said ratchet teeth by axial movement thereof for rotating said support disk when said pawls and teeth are engaged, and for not rotating said support disk when said pawls and teeth are not engaged.

3. A drive mechanism according to claim 2 further comprising:

a plurality of circumferentially spaced apart support clevises fixedly joined to said disk bottom side;

a plurality of pivot pins fixedly joined to respective ones of said pawl proximal ends; and said pivot pins being pivotally joined to said clevises for pivotally mounting said respective pawls thereto.

4. A drive mechanism according to claim 3 further comprising means for preventing excessive axial downward travel of said pawls due to gravity thereon.

5. A drive mechanism according to claim 3 wherein:

each of said clevises includes a pair of spaced apart legs and a base therebetween; and each of said pawls includes a flat extension at said proximal ends thereof predeterminedly spaced from said clevis base for engagement therewith to limit downward overtravel of said pawls under gravity.

6. A drive mechanism according to claim 3 further comprising means for preventing excessive axial upward travel of said pawls due to camming action of said ratchet teeth against said pawl distal ends.

7. A drive mechanism according to claim 3 further comprising a plurality of travel stops extending axially downwardly from said disk bottom side, and predeterminedly axially spaced from said pawls for engaging said pawls to limit upward overtravel thereof due to camming action of said ratchet teeth against said pawl distal ends.

8. A drive mechanism according to claim 3 in combination with said clothes agitator and said auger and wherein:

said agitator includes a top end having an annular step flange therearound, and said ratchet wheel is fixedly joined to said agitator top end; and said auger is hollow with a radially inwardly extending support flange disposed adjacent to a bottom end thereof and axially between said ratchet wheel bottom side and said agitator step flange for securing said auger to said agitator, and said support disk is fixedly joined to said auger axially above said ratchet wheel for allowing ratchet engagement between said pawls and said ratchet teeth for rotating said auger upon oscillation of said agitator.

9. A drive mechanism according to claim 8 further comprising:

means for preventing excessive axial downward travel of said pawls due to gravity thereon; and means for preventing excessive axial upward travel of said pawls due to camming action of said ratchet teeth against said pawl distal ends.

10. A drive mechanism according to claim 8 wherein:

each of said clevises includes a pair of spaced apart legs and a base therebetween;

each of said pawls includes a flat extension at said proximal ends thereof predeterminedly spaced from said clevis base for engagement therewith to limit downward overtravel of said pawls under gravity; and a plurality of travel stops extending axially downwardly from said disk bottom side, and predeterminedly axially spaced from said pawls for engaging said pawls to limit upward overtravel thereof due to camming action of said ratchet teeth against said pawl distal ends.

* * * * *